US012392020B2

(12) United States Patent
Tsutsui et al.

(10) Patent No.: US 12,392,020 B2
(45) Date of Patent: Aug. 19, 2025

(54) HOT-ROLLED STEEL SHEET

(71) Applicant: NIPPON STEEL CORPORATION, Tokyo (JP)

(72) Inventors: Kazumasa Tsutsui, Tokyo (JP); Hiroshi Shuto, Tokyo (JP); Koutarou Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 443 days.

(21) Appl. No.: 17/790,645

(22) PCT Filed: Dec. 11, 2020

(86) PCT No.: PCT/JP2020/046322
§ 371 (c)(1),
(2) Date: Jul. 1, 2022

(87) PCT Pub. No.: WO2021/153036
PCT Pub. Date: Aug. 5, 2021

(65) Prior Publication Data

US 2023/0047602 A1 Feb. 16, 2023

(30) Foreign Application Priority Data

Jan. 27, 2020 (JP) ..... 2020-010945

(51) Int. Cl.
*C22C 38/50* (2006.01)
*C21D 8/02* (2006.01)
(Continued)

(52) U.S. Cl.
CPC ..... *C22C 38/50* (2013.01); *C21D 8/0205* (2013.01); *C21D 8/0226* (2013.01); *C21D 9/46* (2013.01);
(Continued)

(58) Field of Classification Search
CPC ..... C22C 38/50; C22C 38/001; C22C 38/002; C22C 38/005; C22C 38/008; C22C 38/02;
(Continued)

(56) References Cited

U.S. PATENT DOCUMENTS 6,544,354 B1 4/2003 Kawano et al.
11,236,412 B2 2/2022 Sano et al.
(Continued)

FOREIGN PATENT DOCUMENTS

CN 103459647 A 12/2013
CN 107250411 A 10/2017
(Continued)

OTHER PUBLICATIONS

Machine translation of JP-2015196891-A (Foreign Patent Document N).*
(Continued)

*Primary Examiner* — Anthony J Zimmer
*Assistant Examiner* — Mayela Aldaz
(74) *Attorney, Agent, or Firm* — Birch, Stewart, Kolasch & Birch, LLP

(57) ABSTRACT

This hot-rolled steel sheet has a predetermined chemical composition, in which a metallographic structure contains, by area %, more than 92.0% and 100.0% or less of martensite and tempered martensite in total, less than 3.0% of residual austenite, and less than 5.0% of ferrite, has a ratio $S_{60}/S_7$, which is a ratio of a density $S_{60}$ of a length of a grain boundary having a crystal misorientation of 60° to a density $S_7$ of a length of a grain boundary having a crystal misorientation of 7° about a <110> direction, of more than 0.34 and less than 0.60, has a standard deviation of a Mn concentration of 0.60 mass % or less, and has a tensile strength of 980 MPa or more.

4 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/44*** | (2006.01) |
| *C23C 2/06* | (2006.01) |
| *C23C 2/28* | (2006.01) |
| *C23C 2/40* | (2006.01) |

(52) U.S. Cl.

CPC ..... *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/44* (2013.01); *C21D 2211/001* (2013.01); *C21D 2211/005* (2013.01); *C21D 2211/008* (2013.01); *C23C 2/06* (2013.01); *C23C 2/28* (2013.01); *C23C 2/40* (2013.01)

(58) Field of Classification Search

CPC ..... C22C 38/04; C22C 38/06; C22C 38/08; C22C 38/10; C22C 38/12; C22C 38/14; C22C 38/16; C22C 38/44; C22C 38/28; C22C 38/38; C22C 38/60; C22C 38/58; C22C 38/34; C22C 38/42; C21D 8/0205; C21D 8/0226; C21D 9/46; C21D 2211/001; C21D 2211/005; C21D 2211/008; C23C 2/06; C23C 2/28; C23C 2/40

See application file for complete search history.

(56) References Cited

U.S. PATENT DOCUMENTS

| | | | |
|---|---|---|---|
| 2014/0014236 | A1 | 1/2014 | Nozaki et al. |
| 2016/0273066 | A1 | 9/2016 | Sakakibara et al. |
| 2017/0349967 | A1 | 12/2017 | Yokoi et al. |
| 2018/0044749 | A1 | 2/2018 | Shuto et al. |
| 2021/0140005 | A1 | 5/2021 | Yoshida et al. |

FOREIGN PATENT DOCUMENTS

| | | | | |
|---|---|---|---|---|
| EP | 1 028 167 | A2 | | 8/2000 |
| EP | 3 650 569 | A1 | | 5/2020 |
| JP | S 59-222528 | A | | 12/1984 |
| JP | H 10-168544 | A | | 6/1998 |
| JP | 11-61326 | A | | 3/1999 |
| JP | 3355970 | B2 | | 12/2002 |
| JP | 2005-179703 | A | | 7/2005 |
| JP | 2005-298924 | A | | 10/2005 |
| JP | 2007-70648 | A | | 3/2007 |
| JP | 2007070661 | A | | 3/2007 |
| JP | 4109619 | B2 | | 7/2008 |
| JP | 2009-263685 | A | | 11/2009 |
| JP | 4460343 | B2 | | 5/2010 |
| JP | 2012-251200 | A | | 12/2012 |
| JP | 2015-124410 | A | | 7/2015 |
| JP | 2015196891 | A | * | 11/2015 |
| WO | WO 2014/185405 | A1 | | 11/2014 |
| WO | WO 2018/026014 | A1 | | 2/2018 |
| WO | WO 2019/009410 | A1 | | 1/2019 |

OTHER PUBLICATIONS

Naik et al., "Texture-Based Metallurgical Phase Identification in Structural Steels: A Supervised Machine Learning Approach", Metals, 2019, vol. 9, 546, total 13 pages.

Webel et al., "A new analysis approach based on Haralick texture features for the characterization of microstructure on the example of low-alloy steels", Materials Characterization, 2018, vol. 144, pp. 584-596.

Zuiderveld, "Contrast Limited Adaptive Histogram Equalization, Chapter VIII.5", Graphics Gems IV. P.S. Heckbert (Eds.), Cambridge, MA, Academic Press, 1994, pp. 474-485.

* cited by examiner

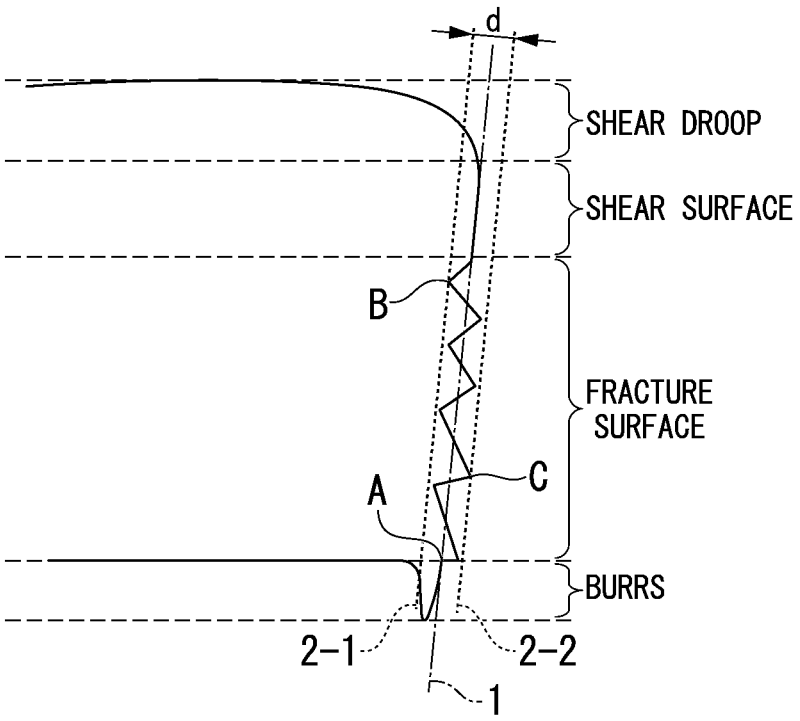
d
SHEAR DROOP
SHEAR SURFACE
B
FRACTURE SURFACE
C
A
BURRS
2-1
2-2
1

HOT-ROLLED STEEL SHEET

TECHNICAL FIELD OF THE INVENTION

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent hole expansibility and shearing workability.

Priority is claimed on Japanese Patent Application No. 2020-010945, filed on Jan. 27, 2020, the content of which is incorporated herein by reference.

BACKGROUND ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to achieve both vehicle body weight reduction and collision resistance, an investigation has been conducted to make a member thin by using a high strength steel sheet. Therefore, steel sheets having both high strength and excellent formability are strongly desired, and some techniques have been conventionally proposed in order to meet these demands.

Since there are various working methods for vehicle members, the required formability differs depending on members to which the working methods are applied, but among these, hole expansibility is placed as important indices for formability. In addition, vehicle members are formed by press forming, and the press-formed blank sheet is often manufactured by highly productive shearing working.

For example, Patent Document 1 discloses a high strength steel sheet for a vehicle having excellent collision resistant safety and formability, in which residual austenite having an average grain size of 5 μm or less is dispersed in ferrite having an average grain size of 10 μm or less. In the steel sheet containing residual austenite in the metallographic structure, while the austenite is transformed into martensite during working and large elongation is exhibited due to transformation-induced plasticity, the formation of full hard martensite impairs hole expansibility. Patent Document 1 discloses that not only ductility but also hole expansibility are improved by refining the ferrite and the residual austenite.

Patent Document 2 discloses a high strength steel sheet having excellent elongation and hole expansibility and having a tensile strength of 980 MPa or more, in which a second phase including residual austenite and/or martensite is finely dispersed in crystal grains.

Patent Documents 3 and 4 disclose a high tensile hot-rolled steel sheet having excellent ductility and hole expansibility, and a method for manufacturing the same. Patent Document 3 discloses a method for manufacturing a high strength hot-rolled steel sheet having good ductility and stretch flangeability, and is a method including cooling a steel sheet to a temperature range of 720° C. or lower within 1 second after the completion of hot rolling, retaining the steel sheet in a temperature range of higher than 500° C. and 720° C. or lower for a retention time of 1 to 20 seconds, and then the coiling the steel sheet in a temperature range of 350° C. to 500° C.

In addition, Patent Document 4 discloses a high strength hot-rolled steel sheet that has good ductility and stretch flangeability and includes bainite as a primary phase and an appropriate amount of polygonal ferrite and residual austenite, in which in a steel structure excluding the residual austenite, an average grain size of grains surrounded by a grain boundary having a crystal misorientation of 15° or more is 15 μm or less.

PRIOR ART DOCUMENT

Patent Document

[Patent Document 1] Japanese Unexamined Patent Application, First Publication No. H11-61326
[Patent Document 2] Japanese Unexamined Patent Application, First Publication No. 2005-179703
[Patent Document 3] Japanese Unexamined Patent Application, First Publication No. 2012-251200
[Patent Document 4] Japanese Unexamined Patent Application, First Publication No. 2015-124410

DISCLOSURE OF THE INVENTION

Problems to be Solved by the Invention

As described above, vehicle components are formed by press forming, and the press-formed blank sheet is often manufactured by highly productive shearing working. In particular, for a steel sheet having a high strength of 980 MPa or more, the load required for a post-treatment such as coining after shearing working is large, and thus it is desired to control the unevenness of a fracture surface in an end surface after shearing working with particularly high accuracy.

All techniques disclosed in Patent Documents 1 to 4 are for improving strength and a press formability during hole expansion, but there is no mention of a technique for improving shearing workability, and a post-treatment is required at a stage of press forming a part, and it is estimated that manufacturing costs will increase.

The present invention has been made in view of the above problems of the related art, and an object of the present invention is to provide a hot-rolled steel sheet having high strength and excellent hole expansibility and shearing workability.

Means for Solving the Problem

In view of the above objects, the present inventors have conducted intensive studies on a chemical composition of a hot-rolled steel sheet and a relationship between a metallographic structure and mechanical properties. As a result, the following findings (a) to (f) were obtained, and the present invention was completed.

In addition, the expression of having excellent shearing workability refers to that an unevenness of the fracture surface in an end surface after shearing working is small. In addition, the expression of having excellent strength or having high strength refers to that tensile strength is 980 MPa or more.

(a) In order to obtain the excellent tensile (maximum) strength and hole expansibility, a primary phase structure of a metallographic structure is preferably full hard. That is, it is preferable that a soft microstructural fraction of ferrite, residual austenite, or the like is as small as possible.

(b) In order to form a large amount of martensite and tempered martensite, it is effective to quickly cool the austenite to a predetermined temperature range. Therefore, it is effective to perform the cooling to a predetermined temperature range without performing intermediate air cooling during the hot rolling process.

(c) A full hard structure is generally formed in a phase transformation at 600° C. or lower, but in this temperature range, a large number of a grain boundary having a crystal misorientation of 60° and a grain boundary having a crystal misorientation of 7° about the <110> direction are formed.

(d) When the grain boundary having a crystal misorientation of 60° about the <110> direction is formed, dislocation is significantly accumulated inside the structure and elastic strain increases. Therefore, in this metallographic structure in which a density of grain boundaries is high and the grain boundaries are uniformly dispersed (that is, a density of length of the grain boundary having a crystal misorientation of 60° about the <110> direction is large), the strength of a material is increased, plastic deformation in shearing working is suppressed, and formation of the unevenness of the fracture surface in the end surface after shearing working is significantly suppressed.

(e) In order to uniformly disperse the grain boundary having a crystal misorientation of 60° about the <110> direction, a standard deviation of a Mn concentration is required to be equal to or less than a certain value. In order to set the standard deviation of the Mn concentration to be equal to or less than a certain value, when a slab is heated, it is effective to retain the slab in a temperature range of 700° C. to 850° C. for 900 seconds or longer, and then further heat the slab, retain in a temperature range of 1100° C. or higher for 6000 seconds or longer, and perform hot rolling so that a total sheet thickness is reduced by 90% or more in the temperature range of 850° C. to 1100° C.

(f) In order to increase a density of the length of the grain boundary having a crystal misorientation of 60° about the <110> direction and decrease a density of the length of the grain boundary having a crystal misorientation of 7° about the <110> direction, it is effective to set a coiling temperature to be less than a predetermined temperature. When the coiling temperature is equal to or higher than the predetermined temperature, the density of the length of the grain boundary having a crystal misorientation of 60° about the <110> direction decreases, and a density of the length of the grain boundary having a crystal misorientation of 7° about the <110> direction increases.

The gist of the present invention made based on the above findings is as follows.

(1) A hot-rolled steel sheet according to an aspect of the present invention includes, as a chemical composition, by mass %:

C: 0.040% to 0.250%;
Si: 0.05% to 3.00%;
Mn: 0.50% to 4.00%;
sol. Al: 0.001% to 2.000%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, or W: 0% to 1.00% in total;
Sn: 0% to 0.050%; and
a remainder comprising Fe and impurities,
in which a metallographic structure
contains, by area %, more than 92.0% and 100.0% or less of martensite and tempered martensite in total, less than 3.0% of residual austenite, and less than 5.0% of ferrite,
has a ratio $S_{60}/S_7$, which is a ratio of a density $S_{60}$ of a length of a grain boundary having a crystal misorientation of 60° to a density $S_7$ of a length of a grain boundary having a crystal misorientation of 7° about a <110> direction, of more than 0.34 and less than 0.60,
has a standard deviation of a Mn concentration of 0.60 mass % or less, and
has a tensile strength of 980 MPa or more.

(2) In the hot-rolled steel sheet according to (1), an average grain size of a surface layer may be less than 3.0 μm.

(3) The hot-rolled steel sheet according to (1) or (2) may include, as a chemical composition, by mass %, one or two or more selected from the group consisting of Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

Effects of the Invention

According to the above aspect of the present invention, it is possible to obtain a hot-rolled steel sheet having excellent strength, hole expansibility, and shearing workability. Further, according to a preferred embodiment according to the present invention, it is possible to obtain a hot-rolled steel sheet having the above-mentioned various properties and further suppressing the occurrence of cracking inside a bend, that is, having excellent resistance to cracking inside a bend.

The hot-rolled steel sheet according to the above aspect of the present invention is suitable as an industrial material used for vehicle members, mechanical structural members, and building members.

BRIEF DESCRIPTION OF THE DRAWING

FIG. 1 is a diagram showing a method of measuring a size of unevenness of a fracture surface in an end surface after shearing working.

EMBODIMENTS OF THE INVENTION

The chemical composition and metallographic structure of a hot-rolled steel sheet (hereinafter, sometimes simply referred to as a steel sheet) according to the present embodiment will be described in detail below. However, the present invention is not limited to the configuration disclosed in the present embodiment, and various modifications can be made without departing from the scope of the present invention.

The numerical limit range described with "to" in between includes the lower limit and the upper limit. Regarding the numerical value indicated by "less than" or "more than", the value does not fall within the numerical range. In the following description, % regarding the chemical composition of the hot-rolled steel sheet is mass % unless otherwise specified.

1. Chemical Composition

The hot-rolled steel sheet according to the present embodiment includes, by mass %, C: 0.040% to 0.250%, Si: 0.05% to 3.00%, Mn: 0.50% to 4.00%, sol. Al: 0.001% to 2.000%, P: 0.100% or less, S: 0.0300% or less, N: 0.1000% or less, O: 0.0100% or less, and a remainder comprising Fe and impurities. Each element will be described in detail below.

(1-1) C: 0.040% to 0.250%

C increases an area fraction of the hard phase. In addition, C increases the strength of martensite by combining to a precipitation hardening element such as Ti, Nb, and V. When the C content is less than 0.040%, it is difficult to obtain a desired strength. Therefore, the C content is set to 0.040% or more. The C content is preferably 0.060% or more and more preferably 0.070% or more.

On the other hand, when the C content is more than 0.250%, the formation of pearlite having a low strength is promoted, and the area fraction of martensite and tempered martensite is lowered, so that the strength of the hot-rolled steel sheet is lowered. Therefore, the C content is set to 0.250% or less. The C content is preferably 0.150% or less.

(1-2) Si: 0.05% to 3.00%

Si has an action of delaying the precipitation of cementite. Due to this action, the area fraction of martensite and tempered martensite can be increased, and the strength of the hot-rolled steel sheet can be increased by solid solution strengthening. In addition, Si has an action of making the steel sound by deoxidation (suppressing the occurrence of defects such as blow holes in the steel). When the Si content is less than 0.05%, an effect by the action cannot be obtained. Therefore, the Si content is set to 0.05% or more. The Si content is preferably 0.50% or more or 1.00% or more.

However, when the Si content is more than 3.00%, the surface properties, the chemical convertibility, the hole expansibility and the weldability of the hot-rolled steel sheet are significantly deteriorated, and the $A_3$ transformation point is significantly increased. This makes it difficult to perform hot rolling in a stable manner. Therefore, the Si content is set to 3.00% or less. The Si content is preferably 2.70% or less and more preferably 2.50% or less.

(1-3) Mn: 0.50% to 4.00%

Mn has actions of suppressing ferritic transformation and high-strengthening the hot-rolled steel sheet. When the Mn content is less than 0.50%, the tensile strength of 980 MPa or more cannot be obtained. Therefore, the Mn content is set to 0.50% or more. The Mn content is preferably 1.00% or more, 1.50% or more, or 1.80% or more.

On the other hand, when the Mn content is more than 4.00%, the crystal misorientation of the crystal grain in the hard phase becomes non-uniform due to the segregation of Mn, and the unevenness of the fracture surface in the end surface after shearing working becomes large. Therefore, the Mn content is set to 4.00% or less. The Mn content is preferably 3.70% or less or 3.50% or less.

(1-4) sol. Al: 0.001% to 2.000%

Similar to Si, Al has an action of making the steel sound by deoxidation, and also has an action of increasing the area fraction of the martensite and the tempered martensite by suppressing the precipitation of cementite from austenite. When a sol. Al content is less than 0.001%, an effect by the action cannot be obtained. Therefore, the sol. Al content is set to 0.001% or more. The sol. Al content is preferably 0.010% or more.

On the other hand, when the sol. Al content is more than 2.000%, the above effects are saturated and this case is not economically preferable. Thus, the sol. Al content is set to 2.000% or less. The sol. Al content is preferably 1.500% or less or 1.300% or less.

The sol. Al in the present embodiment means acid-soluble Al, and refers to solid solution Al present in steel in a solid solution state.

(1-5) P: 0.100% or less

P is an element that is generally contained as an impurity and is also an element having an action of enhancing the strength by solid solution strengthening. Therefore, although P may be positively contained, P is an element that is easily segregated, and when the P content is more than 0.100%, the hole expansibility is significantly decreased due to the boundary segregation. Therefore, the P content is set to 0.100% or less. The P content is preferably 0.030% or less.

The lower limit of the P content does not need to be particularly specified, but is preferably 0.001% from the viewpoint of refining cost.

(1-6) S: 0.0300% or less

S is an element that is contained as an impurity and forms sulfide-based inclusions in the steel to decrease the hole expansibility of the hot-rolled steel sheet. When the S content is more than 0.0300%, the hole expansibility of the hot-rolled steel sheet is significantly decreased. Therefore, the S content is set to 0.0300% or less. The S content is preferably 0.0050% or less.

The lower limit of the S content does not need to be particularly specified, but is preferably 0.0001% from the viewpoint of refining cost.

(1-7) N: 0.1000% or less

N is an element contained in steel as an impurity and has an action of decreasing the hole expansibility of the hot-rolled steel sheet. When the N content is more than 0.1000%, the hole expansibility of the hot-rolled steel sheet is significantly decreased. Therefore, the N content is set to 0.1000% or less. The N content is preferably 0.0800% or less and more preferably 0.0700% or less.

Although the lower limit of the N content does not need to be particularly specified, as will be described later, in a case where one or two or more of Ti, Nb, and V are contained to refine the metallographic structure, the N content is preferably 0.0010% or more and more preferably 0.0020% or more to promote the precipitation of carbonitride.

(1-8) O: 0.0100% or less

When a large amount of O is contained in the steel, O forms a coarse oxide that becomes the origin of fracture, and causes brittle fracture and hydrogen-induced cracks. Therefore, the O content is set to 0.0100% or less. The O content is preferably 0.0080% or less and 0.0050% or less.

The O content may be 0.0005% or more or 0.0010% or more to disperse a large number of fine oxides when the molten steel is deoxidized.

The remainder of the chemical composition of the hot-rolled steel sheet according to the present embodiment may be Fe and impurities. In the present embodiment, the impurities mean those mixed from ore as a raw material, scrap, manufacturing environment, and the like, and are allowed within a range that does not adversely affect the hot-rolled steel sheet according to the present embodiment.

In addition to the above elements, the hot-rolled steel sheet according to the present embodiment may contain Ti, Nb, V, Cu, Cr, Mo, Ni, B, Ca, Mg, REM, Bi, Zr, Co, Zn, W, and Sn as optional elements. In a case where the above optional elements are not contained, the lower limit of the content thereof is 0%. Hereinafter, the above optional elements will be described in detail.

(1-9) Ti: 0.005% to 0.300%, Nb: 0.005% to 0.100%, and V: 0.005% to 0.500%

Since all of Ti, Nb, and V are precipitated as carbides or nitrides in the steel and have an action of refining the metallographic structure by an austenite pinning effect, one or two or more of these elements may be contained. In order to more reliably obtain the effect by the action, it is preferable that the Ti content is set to 0.005% or more, the Nb content is set to 0.005% or more, or the V content is set to 0.005% or more. That is, it is preferable that the amount of even one of Ti, Nb, and V is 0.005% or more.

However, even when these elements are excessively contained, the effect by the action is saturated, and this case is not economically preferable. Therefore, the Ti content is set to 0.300% or less, the Nb content is set to 0.100% or less, and the V content is set to 0.500% or less. The Ti content is preferably 0.200% or less, 0.150% or less, 0.120% or less, 0.110% or less, or 0.100% or less.

(1-10) Cu: 0.01% to 2.00%, Cr: 0.01% to 2.00%, Mo: 0.01% to 1.00%, Ni: 0.02% to 2.00%, and B: 0.0001% to 0.0100%

All of Cu, Cr, Mo, Ni, and B have an action of enhancing the hardenability of the hot-rolled steel sheet. In addition, Cr and Ni have an action of stabilizing austenite, and Cu and Mo have an action of precipitating carbides in the steel at a low temperature to increase the strength. Further, in a case where Cu is contained, Ni has an action of effectively suppressing the grain boundary crack of the slab caused by Cu. Therefore, one or two or more of these elements may be contained.

As described above, Cu has an action of enhancing the hardenability of the hot-rolled steel sheet and an action of being precipitated as carbide in the steel at a low temperature to enhance the strength of the hot-rolled steel sheet. In order to more reliably obtain the effect by the action, the Cu content is preferably 0.01% or more and more preferably 0.05% or more. However, when the Cu content is more than 2.00%, grain boundary cracks may occur in the slab in some cases. Therefore, the Cu content is set to 2.00% or less. The Cu content is preferably 1.50% or less and 1.00% or less.

As described above, Cr has an action of enhancing the hardenability of the hot-rolled steel sheet and an action of precipitating carbides in the steel at the low temperature to enhance the strength. In order to more reliably obtain the effect by the action, the Cr content is preferably 0.01% or more or 0.05% or more. However, when the Cr content is more than 2.00%, the chemical convertibility of the steel sheet is significantly decreased. Accordingly, the Cr content is set to 2.00% or less.

As described above, Mo has an action of enhancing the hardenability of the hot-rolled steel sheet and an action of precipitating carbides in the steel to enhance the strength. In order to more reliably obtain the effect by the action, the Mo content is preferably 0.01% or more or 0.02% or more. However, even when the Mo content is set to be more than 1.00%, the effect by the action is saturated, and this case is not economically preferable. Therefore, the Mo content is set to 1.00% or less. The Mo content is preferably 0.50% or less and 0.20% or less.

As described above, Ni has an action of enhancing the hardenability of the hot-rolled steel sheet. In addition, when Cu is contained, Ni has an action of effectively suppressing the grain boundary crack of the slab caused by Cu. In order to more reliably obtain the effect by the action, the Ni content is preferably 0.02% or more. Since Ni is an expensive element, it is not economically preferable to contain a large amount of Ni. Therefore, the Ni content is set to 2.00% or less.

As described above, B has an action of enhancing the hardenability of the hot-rolled steel sheet. In order to more reliably obtain the effect by the action, the B content is preferably 0.0001% or more or 0.0002% or more. However, when the B content is more than 0.0100%, the hole expansibility of the steel sheet is significantly decreased, and thus the B content is set to 0.0100% or less. The B content is preferably 0.0050% or less.

(1-11) Ca: 0.0005% to 0.0200%, Mg: 0.0005% to 0.0200%, REM: 0.0005% to 0.1000%, and Bi: 0.0005% to 0.020%

All of Ca, Mg, and REM have an action of enhancing the formability of the hot-rolled steel sheet by adjusting the shape of inclusions to a preferable shape. In addition, Bi has an action of enhancing the formability of the hot-rolled steel sheet by refining the solidification structure. Therefore, one or two or more of these elements may be contained.

In order to more reliably obtain the effect by the action, it is preferable that any one or more of Ca, Mg, REM, and Bi is 0.0005% or more. However, when the Ca content or Mg content is more than 0.0200%, or when the REM content is more than 0.1000%, the inclusions are excessively formed in the steel, and thus the hole expansibility of the hot-rolled steel sheet may be decreased in some cases. In addition, even when the Bi content is more than 0.020%, the above effect by the action is saturated, and this case is not economically preferable. Therefore, the Ca content and Mg content are set to 0.0200% or less, the REM content is set to 0.1000% or less, and the Bi content is set to 0.020% or less. The Bi content is preferably 0.010% or less.

Here, REM refers to a total of 17 elements including Sc, Y, and lanthanoid, and the REM content refers to the total amount of these elements. In a case of the lanthanoid, lanthanoid is industrially added in the form of misch metal.

(1-12) One or Two or More of Zr, Co, Zn, or W: 0% to 1.00% in Total and Sn: 0% to 0.050%

Regarding Zr, Co, Zn, and W, the present inventors have confirmed that even when the total amount of these elements is 1.00% or less, the effect of the hot-rolled steel sheet according to the present embodiment is not impaired. Therefore, one or two or more of Zr, Co, Zn, or W may be contained in a total of 1.00% or less.

Further, the present inventors have confirmed that the effect of the hot-rolled steel sheet according to the present embodiment is not impaired even if a small amount of Sn is contained. However, when a large amount of Sn is contained, a defect may occur during hot rolling, and thus, the Sn content is set to 0.050% or less.

The above-described chemical composition of the hot-rolled steel sheet may be measured by a general analytical method. For example, inductively coupled plasma-atomic emission spectrometry (ICP-AES) may be used for measurement. In addition, sol. Al may be measured by the ICP-AES using a filtrate after heat-decomposing a sample with an acid. C and S may be measured by using a combustion-infrared absorption method, and N may be measured by using the inert gas melting-thermal conductivity method.

2. Metallographic Structure of Hot-Rolled Steel Sheet

Next, the metallographic structure of the hot-rolled steel sheet according to the present embodiment will be described.

In the hot-rolled steel sheet according to the present embodiment, the metallographic structure contains more than 92.0% and 100.0% or less of martensite and tempered martensite in total, less than 3.0% of residual austenite, and less than 5.0% of ferrite, has a ratio $S_{60}/S_7$, which is a ratio of a density $S_{60}$ of a length of a grain boundary having a crystal misorientation of 60° to a density $S_7$ of a length of a grain boundary having a crystal misorientation of 7° about a <110> direction, of more than 0.34 and less than 0.60, and has a standard deviation of a Mn concentration of 0.60 mass % or less. Therefore, the hot-rolled steel sheet according to the present embodiment can obtain excellent strength, ductility, and shearing workability.

In the present embodiment, the metallographic structure is defined at a depth of ¼ of the sheet thickness from a surface and a center position in a sheet width direction in a cross section parallel to a rolling direction. The reason is that the metallographic structure at this position is a typical metallographic structure of a steel sheet.

The position at the depth of ¼ of the sheet thickness from the surface is a region between a depth of ⅛ of the sheet thickness from the surface and a depth of ⅜ of the sheet thickness from the surface.

(2-1) Area Fraction of Residual Austenite: Less than 3.0%

The residual austenite is a structure that is present as a face-centered cubic lattice even at room temperature. The residual austenite has an action of increasing the ductility of the hot-rolled steel sheet due to transformation-induced plasticity (TRIP). On the other hand, the residual austenite is transformed into high-carbon martensite during shearing working, thus, inhibits stable crack initiation, and causes the unevenness of the fracture surface in the end surface after shearing working to be large. When the area fraction of the residual austenite is 3.0% or more, the above-mentioned action is manifested, and not only the shearing workability of the hot-rolled steel sheet is deteriorated (the unevenness of the fracture surface in the end surface becomes large), but also the hole expansibility is also decreased. Therefore, the area fraction of the residual austenite is set to less than 3.0%. The area fraction of the residual austenite is preferably less than 1.0%. Since less residual austenite is preferable, the area fraction of the residual austenite may also be 0%.

(2-2) Area Fraction of Ferrite: Less Than 5.0%

Ferrite is generally a soft structure. When a predetermined amount or more of ferrite is contained, not only the desired strength cannot be obtained, but also the region of the shear surface on the end surface after shearing working is caused to increase. When the region of the shear surface in the end surface after shearing working is increased, the unevenness of the fracture surface becomes large, which is not preferable. When the area fraction of the ferrite is 5.0% or more, the action is manifested, shearing workability of the hot-rolled steel sheet is deteriorated. Therefore, the area fraction of the ferrite is set to less than 5.0%. The area fraction of the ferrite is preferably less than 1.0%. Since less ferrite is preferable, the area fraction of the ferrite may be 0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In the present embodiment, the area fraction of the residual austenite is measured by X-ray diffraction.

In the measurement of the area fraction of the residual austenite by X-ray diffraction in the present embodiment, first, the integrated intensities of a total of 6 peaks of α(110), α(200), α(211), γ(111), γ(200), and γ(220) are obtained in the cross section parallel to the rolling direction at a depth of ¼ of the sheet thickness of the steel sheet (region between a depth of ⅛ of the sheet thickness from the surface and a depth of ⅜ of the sheet thickness from the surface) and the center position in the sheet width direction, using Co-Kα rays, and the area fraction of the residual austenite is obtained by calculation using the strength averaging method.

Measurement of the area fraction of the ferrite is conducted in the following manner. The cross section perpendicular to the rolling direction is mirror-finished and polished at a room temperature with colloidal silica without containing an alkaline solution for 8 minutes to remove the strain introduced into the surface layer of a sample. In a random position of the sample cross section in a longitudinal direction, a region with a length of 50 μm and between a depth of ⅛ of the sheet thickness from the surface to a depth of ⅜ of the sheet thickness from the surface is measured by electron backscatter diffraction at a measurement interval of 0.1 μm to obtain crystal orientation information.

For the measurement, an EBSD analyzer configured of a thermal field emission scanning electron microscope (JSM-7001F manufactured by JEOL) and an EBSD detector (DVC5 type detector manufactured by TSL) is used. In this case, the EBSD analyzer is set such that the degree of vacuum inside is $9.6\times10^{-5}$ Pa or less, an acceleration voltage is 15 kV, an irradiation current level is 13, and an electron beam irradiation level is 62. A region where a Grain Average Misorientation value is 1.0° or less is determined to be ferrite, using the obtained crystal orientation information in a "Grain Average Misorientation" installed in the software "OIM Analysis (registered trademark)" (manufactured by AMETEK, Inc.) attached to the EBSD analyzer. When determining the area fraction of the region determined as the ferrite, the area fraction of the ferrite is obtained.

(2-3) Total Area Fraction of Martensite and Tempered Martensite: More than 92.0% and 100.0% or Less When the total area fraction of the martensite and the tempered martensite is 92.0% or less, the desired strength cannot be obtained. Therefore, the total area fraction of the martensite and the tempered martensite is set to more than 92.0%. It is not necessary to include both the martensite and the tempered martensite, and in a case where any one of the martensite or the tempered martensite is contained, the area fraction may be more than 92.0%. In a case where both the martensite and the tempered martensite are contained, the total area fraction of the martensite and the tempered martensite may be more than 92.0%. The total area fraction of the martensite and the tempered martensite is preferably 95.0% or more, 97.0% or more, or 99.0% or more.

Since the larger total area fraction of the martensite and the tempered martensite is preferable, the total area fraction may be 100.0%.

The method for measuring the area fraction of the martensite and the tempered martensite will be described below.

First, in order to observe the same region as the EBSD measurement region where the area fraction of the ferrite has been measured, by SEM, a Vickers indentation is imprinted in the vicinity of the observation position. Thereafter, a contamination on the surface layer is removed by polishing, leaving the structure of the observed section, and nital etching is performed. Next, the same visual field as the EBSD observed section is observed by SEM at a magnification of 3000 times.

In the EBSD measurement, among the regions determined as the remainder in the microstructure, a region having a substructure in the grain and where cementite precipitates with a plurality of variants is determined to be tempered martensite. A region where the brightness is high and the substructure is not exposed by etching is determined as "martensite and residual austenite". By calculating the area fraction of each structure, the area fractions of the tempered martensite, and the "martensite and residual austenite" are obtained. The area fraction of the martensite can be obtained by subtracting the area fraction of the residual austenite obtained by the above-mentioned X-ray diffraction from the obtained area fraction of the "martensite and residual austenite".

For removing contamination on the surface layer of the observed section, a method such as buffing using alumina particles having a particle diameter of 0.1 μm or less or Ar ion sputtering may be used.

(2-4) Ratio $S_{60}/S_7$, which is a Ratio of a Density $S_{60}$ of Length of Grain Boundary having Crystal Misorientation of 60° to a Density $S_7$ of Length of Grain Boundary having Crystal Misorientation of 7° about ≤110> Direction: More than 0.34 and Less than 0.60

In order to obtain a hot-rolled steel sheet having a tensile strength of 980 MPa or more, a primary phase is necessary to be a full hard structure. The full hard structure is generally formed in a phase transformation at 600° C. or lower, but in this temperature range, a large number of a grain boundary having a crystal misorientation of 60° and a grain boundary having a crystal misorientation of 7° about the <110> direction are formed.

When the grain boundary having a crystal misorientation of 60° about the <110> direction is formed, dislocation is significantly accumulated inside the structure and elastic strain increases. Therefore, in a metallographic structure in which the grain boundary having a crystal misorientation of 60° about the <110> direction have high density and are uniformly dispersed (that is, a density of length of the grain boundary having a crystal misorientation of 60° about the <110> direction is large), the strength of a material is increased, plastic deformation in shearing working is suppressed, and the unevenness of the fracture surface in the end surface after shearing working is suppressed.

On the other hand, at the grain boundary having a crystal misorientation of 7° about the <110> direction, a dislocation density inside the structure is low and an elastic strain is also small. Thus, the unevenness of the fracture surface in the end surface after shearing working significantly increases. Therefore, when the density of the length of a grain boundary having a crystal misorientation of 60° about a <110> direction is set to $S_{60}$ and the density of the length of the grain boundary having a crystal misorientation of 7° about a <110> direction is set to $S_7$, the size of the unevenness of the fracture surface in the end surface after shearing working is dominated by $S_{60}/S_7$.

In a case where the $S_{60}/S_7$ is 0.34 or less, not only the tensile strength of the hot-rolled steel sheet cannot be 980 MPa or more, but also the unevenness of the fracture surface in the end surface after shearing working becomes large. Accordingly, $S_{60}/S_7$ is set to more than 0.34. The $S_{60}/S_7$ is preferably 0.40 or more or 0.45 or more. In order to suppress the unevenness of the fracture surface in the end surface after shearing working, the larger $S_{60}/S_7$ is desirable, but a practical upper limit is 0.60. Therefore, $S_{60}/S_7$ is set to less than 0.60.

The grain boundary having a crystal misorientation of X° about the <110> direction refers to a grain boundary having a crystallographic relationship in which the crystal orientations of the crystal grain A and the crystal grain B are the same by rotating one crystal grain B by X° about the <110> axis, when two adjacent crystal grain A and crystal grain B are specified at a certain grain boundary. However, considering the measurement accuracy of the crystal orientation, an orientation difference of +4° is allowed from the matching orientation relationship.

In the present embodiment, the density $S_{60}$ of the length of the grain boundary having a crystal misorientation of 60° and the density $S_7$ of the length of a grain boundary having a crystal misorientation of 7° about the <110> direction are measured by using the electron back scatter diffraction pattern-orientation image microscopy (EBSP-OIM) method. In the EBSP-OIM method, a crystal orientation of an irradiation point can be measured for a short time period in such manner that a highly inclined sample in a scanning electron microscope (SEM) is irradiated with electron beams, a Kikuchi pattern formed by back scattering is photographed by a high sensitive camera, and the photographed image is processed by a computer.

The EBSP-OIM method is carried out using an EBSD analyzer configured of a thermal field emission scanning electron microscope (JSM-7001F manufactured by JEOL) and an EBSD detector, and OIM Analysis (registered trademark) manufactured by AMETEK, Inc. In the EBSP-OIM method, since the fine structure of the sample surface and the crystal orientation can be analyzed, the length of the grain boundary having a specific crystal misorientation can be quantitatively determined. The analyzable area of the EBSP-OIM method is a region that can be observed by the SEM. The EBSP-OIM method makes it possible to analyze a region with a minimum resolution of 20 nm, which varies depending on the resolution of the SEM.

In measuring the length of specific grain boundaries of the metallographic structure at the depth of ¼ of the sheet thickness from the steel sheet surface (region between a depth of ⅛ of the sheet thickness from the surface and a depth of ⅜ of the sheet thickness from the surface) and the center position in the sheet width direction in the cross section parallel to the rolling direction, the analysis is performed with 1200 fold magnification, in a region of 40 μm×30 μm, for at least 5 visual fields. Moreover, $S_{60}$ is obtained by dividing an average value of the lengths of the grain boundary having a crystal misorientation of 60° about the <110> direction by the area of the measurement region. Similarly, $S_7$ is obtained by dividing an average value of the lengths of the grain boundary having a crystal misorientation of 7° about the <110> direction by the area of the measurement region. As described above, the orientation difference of ±4° is allowed.

Since the residual austenite is not a structure formed by phase transformation at 600° C. or lower and has no effect of dislocation accumulation, the residual austenite is not included as a target in the analysis in the present measurement method. That is, in the present embodiment, the density $S_{60}$ of the length of a grain boundary having a crystal misorientation of 60° about the <110> direction and the density $S_7$ of the length of a grain boundary having a crystal misorientation of 7° about the <110> direction are the density of martensite, tempered martensite, or ferrite. The EBSP-OIM method, the residual austenite having a crystal structure of fcc can be excluded from the analysis target.

(2-5) Standard Deviation of Mn Concentration: 0.60 Mass % or Less

The standard deviation of the Mn concentration at a depth of ¼ of the sheet thickness from a surface of the hot-rolled steel sheet according to the present embodiment (region between a depth of ⅛ of the sheet thickness from the surface and a depth of ⅜ of the sheet thickness from the surface) and the center position in the sheet width direction is 0.60 mass % or less. Accordingly, the grain boundary having a crystal misorientation of 60° about the <110> direction can be uniformly dispersed. As a result, the unevenness of the fracture surface in the end surface after shearing working can be reduced. The standard deviation of the Mn concentration is preferably 0.55 mass % or less, 0.50 mass % or less, or 0.40 mass % or less.

A lower limit of the standard deviation of the Mn concentration is preferably as small as the value, in order to suppress the unevenness of the fracture surface in the end surface after the shearing working, but a practical lower limit is 0.10 mass % due to the restrictions of the manufacturing process.

The standard deviation of the Mn concentration is measured by the following method.

After the L cross section of the hot-rolled steel sheet is mirror polished, the center position in the sheet width direction at the depth of ¼ of the sheet thickness from the surface (region between a depth of ⅛ of the sheet thickness from the surface and a depth of ⅜ of the sheet thickness from the surface) is measured using an electron probe microanalyzer (EPMA) to measure the standard deviation of the Mn concentration. The measurement condition is set such that an acceleration voltage is 15 kV and the magnification is 5000 times, and a distribution image in the range of 20 μm in the sample rolling direction and 20 μm in the sample sheet thickness direction is measured. More specifically, the measurement interval is set to 0.1 μm, and the Mn concentration at 40000 or more points is measured. Then, a standard deviation based on the Mn concentration obtained from all the measurement point is calculated to obtain the standard deviation of the Mn concentration.

(2-6) Average Grain Size of Surface Layer: less than 3.0 μm

When the grain size of the surface layer is fine, it is possible to suppress having excellent resistance to cracking inside a bend of the hot-rolled steel sheet. As the strength of the steel sheet becomes higher, cracks are likely to initiate from an inside of a bend during bending (hereinafter referred to as cracking inside a bend).

The mechanism of the cracking inside a bend is presumed as follows. During bending, compressive stress is generated inside the bend. At first, bending proceeds while uniformly deforming the entire inside of the bend, but when the bending amount increases, the deformation cannot be carried out only by uniform deformation, and the deformation proceeds due to the concentration of strain locally (generation of shearing deformation band). As this shearing deformation band further propagates, cracks along the shearing band are initiated from the inner surface of the bend and propagate. The reason why the cracking inside a bend is more likely to be initiated along with the high-strengthening is presumed that when uniform deformation is less likely to proceed due to the decrease in work hardening ability along with the strength increasing and a deformation bias is likely to occur, a shearing deformation band is formed at an early stage of working (or in a mild working condition).

According to the research by the present inventors, it was found that the cracking inside a bend becomes remarkable in the steel sheet having the tensile strength of 980 MPa or more. Furthermore, the present inventors have found that as the grain size of the surface layer of the hot-rolled steel sheet is finer, the local strain concentration is further suppressed and the cracking inside a bend becomes difficult to occur. In order to obtain the action, it is preferable that the average grain size of the surface layer of the hot-rolled steel sheet is less than 3.0 μm. It is more preferable that the average grain size is 2.5 μm or less. The lower limit is not particularly limited, and may be 1.0 μm or more, 1.5 μm or more, or 2.0 μm or more.

In the present embodiment, the surface layer is a region from the surface of the hot-rolled steel sheet to a position at a depth of 50 μm from the surface.

The grain size of the surface layer is measured by using the EBSP-OIM method. In the cross section parallel to the rolling direction, a region from the surface of the hot-rolled steel sheet to a position at a depth of 50 μm from the surface and the center position in the sheet width direction is analyzed with 1200 fold magnification, in a region of 40 μm×30 μm, for at least 5 visual field, a place where the angular difference between adjacent measurement points is 5° or more is defined as a grain boundary, and an area average grain size is calculated. The obtained area average grain size is defined as the average grain size of the surface layer.

Since the residual austenite is not a structure formed by phase transformation at 600° C. or lower and has no effect of dislocation accumulation, the residual austenite is not included as a target in the analysis in the present measurement method. That is, in the present embodiment, the average grain size of the surface layer is a grain size of martensite, tempered martensite, and ferrite. The EBSP-OIM method, the residual austenite having a crystal structure of fcc can be excluded from the analysis target.

3. Tensile Strength Properties

The hot-rolled steel sheet according to the present embodiment has a tensile (maximum) strength of 980 MPa or more. When the tensile strength is less than 980 MPa, an applicable component is limited, and the contribution of weight reduction of the vehicle body is small. An upper limit is not particularly limited, and may be 1780 MPa from the viewpoint of suppressing wearing of a die.

The tensile strength is measured according to JIS Z 2241:2011 using a No. 5 test piece of JIS Z 2241:2011. The sampling position of the tensile test piece may be ¼ portion from the end portion in the sheet width direction, and the direction perpendicular to the rolling direction may be the longitudinal direction.

4. Hole Expansion Properties

The hot-rolled steel sheet according to the present embodiment preferably has a hole expansion ratio λ of 62% or more. When the hole expansion ratio A is 62% or more, the applicable components are not limited, and a hot-rolled steel sheet that greatly contributes to weight reduction of the vehicle body can be obtained. An upper limit thereof does not need to be limited.

The hole expansion ratio λ is measured according to JIS Z 2256:2010 using a No. 5 test piece of JIS Z 2241:2011. The sampling position of the hole expansion test piece may be ¼ part from the end portion in the sheet width direction.

Further, the product (TS×λ) of the tensile strength and the hole expansion which are indices of hole expansibility is preferably 60000 MPa % or more. When the product of the tensile strength and the hole expansion is 60000 MPa·% or more, it is possible to obtain a hot-rolled steel sheet that greatly contributes to weight reduction of a vehicle body without limiting applicable components.

5. Sheet Thickness

The sheet thickness of the hot-rolled steel sheet according to the present embodiment is not particularly limited and may be 0.5 to 8.0 mm. By setting the sheet thickness of the hot-rolled steel sheet to 0.5 mm or more, it becomes easy to secure the rolling completion temperature, and it is also possible to reduce rolling force, and to easily perform hot rolling. Therefore, the sheet thickness of the hot-rolled steel sheet according to the present embodiment may be 0.5 mm or more. The sheet thickness is preferably 1.2 mm or more and 1.4 mm or more. In addition, when the sheet thickness is set to 8.0 mm or less, the metallographic structure can be easily refined, and the above-described metallographic structure can be easily secured. Therefore, the sheet thickness may be 8.0 mm or less. The sheet thickness is preferably 6.0 mm or less.

6. Others (6-1) Plating Layer

The hot-rolled steel sheet according to the present embodiment having the above-described chemical composition and metallographic structure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating.

The plating adhesion amount is not particularly limited and may be the same as before. Further, it is also possible to further enhance the corrosion resistance by applying an appropriate chemical conversion treatment (for example, application and drying of a silicate-based chromium-free chemical conversion treatment liquid) after plating.

7. Manufacturing Conditions

A suitable method for manufacturing the hot-rolled steel sheet according to the present embodiment having the above-mentioned chemical composition and metallographic structure is as follows.

In order to obtain the hot-rolled steel sheet according to the present embodiment, it is effective that after performing heating the slab under predetermined conditions, hot rolling is performed and accelerated cooling is performed to a predetermined temperature range, and after coiling, the cooling history is controlled.

In the suitable method for manufacturing the hot-rolled steel sheet according to the present embodiment, the following steps (1) to (7) are sequentially performed. The temperature of the slab and the temperature of the steel sheet in the present embodiment refer to the surface temperature of the slab and the surface temperature of the steel sheet.

(1) The slab is retained in a temperature range of 700° C. to 850° C. for 900 seconds or longer, then further heated, and retained in a temperature range of 1100° C. or higher for 6000 seconds or longer.

(2) Hot rolling is performed in a temperature range of 850° C. to 1100° C. so that the total sheet thickness is reduced by 90% or more.

(3) The Hot rolling is completed so that a hot rolling completion temperature Tf becomes equal to or higher than a temperature T1 (° C.) represented by Formula <1>.

(4) Accelerated cooling is started within 1.5 seconds after the completion of the hot rolling, and the average cooling rate to temperature range of a temperature T2 (° C.) or lower represented by Expression <2> is set to 30° C./s or higher.

More preferably, the cooling is performed within 1.0 second after the completion of hot rolling to a temperature range of the hot rolling completion temperature Tf-50° C. or lower.

(5) Cooling is performed from T2 (° C.) to the coiling temperature at an average cooling rate of 30° C./s or higher.

(6) The coiling temperature is set to a temperature range of 300° C. or lower.

$$T1(^\circ C.)=868-396\times[C]-68.1\times[Mn]+24.6\times[Si]-36.1\times[Ni]-24.8\times[Cr]-20.7\times[Cu]+250\times[sol\cdot Al] \ldots <1>$$

$$T2(^\circ C.)=770-270\times[C]-90\times[Mn]-37\times[Ni]-70\times[Cr]-83\times[Mo] \ldots <2>$$

However, the [element symbol] in each expression indicates the content (mass %) of each element in the steel. When the element is not contained, substitution is performed with 0.

(7-1) Slab, Slab Temperature When Subjected to Hot Rolling, and Retention Time

As a slab to be subjected to hot rolling, a slab obtained by continuous casting, a slab obtained by casting and blooming, and the like can be used, and slabs obtained by performing hot working or cold working on these slabs as necessary can be used.

The slab to be subjected to hot rolling is preferably retained in a temperature range of 700° C. to 850° C. during heating for 900 seconds or longer, then further heated and retained in a temperature range of 1100° C. or higher for 6000 seconds or longer. During retaining in the temperature range of 700° C. to 850° C., the steel sheet temperature may be fluctuated or be constant in the temperature range. Furthermore, during retaining in the temperature range of 1100° C. or higher, the steel sheet temperature may be fluctuated or be constant in the temperature range of 1100° C. or higher.

In the austenite transformation at 700° C. to 850° C., when Mn is distributed between the ferrite and the austenite and the transformation time becomes longer, Mn can be diffused in the ferrite region. Accordingly, the Mn microsegregation unevenly distributed in the slab can be eliminated, and the standard deviation of the Mn concentration can be significantly reduced. By reducing the standard deviation of the Mn concentration, it is possible to uniformly disperse the grain boundaries having a crystal misorientation of 60° about the <110> direction in the final metallographic structure, and reduce the unevenness of the fracture surface in the end surface after shearing working.

Further, in order to make the austenite grains uniform during slab heating, it is preferable to heat the slab in the temperature range of 1100° C. or higher for 6000 seconds or longer.

In hot rolling, it is preferable to use a reverse mill or a tandem mill for multi-pass rolling. Particularly, from the viewpoint of industrial productivity, it is more preferable that at least the final several stages are subjected to hot rolling using a tandem mill.

(7-2) Rolling Reduction of Hot Rolling: Total Sheet Thickness Reduction of 90% or More in Temperature Range of 850° C. to 1100° C.

Performing the hot rolling to obtain a total sheet thickness reduction of 90% or more in the temperature range of 850° C. to 1100° C. makes it possible that the accumulation of strain energy inside unrecrystallized austenite grains is promoted while achieving refinement mainly of the recrystallized austenite grains, and the atomic diffusion of Mn is promoted while promoting the recrystallization of the austenite to reduce the standard deviation of the Mn concentration.

By reducing the standard deviation of the Mn concentration, it is possible to uniformly disperse the grain boundaries having a crystal misorientation of 60° about the <110> direction in the final metallographic structure, and reduce the unevenness of the fracture surface in the end surface after shearing working. Therefore, the hot rolling is performed in a temperature range of 850° C. to 1100° C. so that the total sheet thickness is reduced by 90% or more.

The sheet thickness reduction in a temperature range of 850° C. to 1100° C. can be expressed as $(t_0-t_1)/t_0\times100$ (%) when an inlet sheet thickness before the first pass in the rolling in this temperature range is to and an outlet sheet thickness after the final pass in the rolling in this temperature range is $t_1$.

(7-3) Hot rolling Completion Temperature Tf: T1 (° C.) or Higher

The hot rolling completion temperature Tf is preferably set to T1 (° C.) or higher. By setting the hot rolling completion temperature Tf to T1 (° C.) or higher, an excessive increase in the number of ferrite nucleation sites in the austenite can be suppressed, and the formation of the ferrite in the final structure (the metallographic structure of the hot-rolled steel sheet after manufacturing) can be suppressed, and it is possible to obtain the hot-rolled steel sheet having high strength.

(7-4) Accelerated Cooling After Completion of Hot Rolling: Starting Accelerated Cooling Within 1.5 Seconds and Setting Average Cooling Rate to T2 (° C.) or Lower to 30° C./s or Higher In order to suppress the growth of austenite crystal grains refined by hot rolling, it is preferable to perform accelerated cooling to T2 (° C.) or lower within 1.5 seconds after the completion of hot rolling at an average cooling rate of 30° C./s or higher.

By performing accelerated cooling to T2 (C) or lower within 1.5 seconds after the completion of hot rolling at an average cooling rate of 30° C./s or higher, the formation of ferrite and pearlite can be suppressed. Accordingly, the strength of the hot-rolled steel sheet is enhanced. The average cooling rate referred herein is a value obtained by dividing the temperature drop width of the steel sheet from the start of accelerated cooling (when introducing a steel sheet to cooling equipment) to T2 (° C.) by the time required from the start of accelerated cooling to the time at which the temperature of the steel sheet reaches T2 (° C.).

In the accelerated cooling after completion of hot rolling, when the time to start cooling is set to be within 1.5 seconds and the average cooling rate to T2 (C) or lower is set to 30° C./s or higher, the ferritic transformation, bainitic transformation, and/or pearlitic transformation inside the steel sheet can be suppressed, and TS ≥980 MPa can be obtained. Therefore, within 1.5 seconds after the completion of hot rolling, the accelerated cooling in which the average cooling rate to T2 (° C.) or lower is 30° C./s or higher is performed.

The upper limit of the average cooling rate is not particularly specified, but when the cooling rate is increased, the cooling equipment becomes large and the equipment cost increases. Therefore, considering the equipment cost, the average cooling rate of accelerated cooling is preferably 300° C./s or lower. In addition, the cooling stop temperature of the accelerated cooling may be set to 350° C. or lower.

In cooling after the completion of the hot rolling, cooling to a temperature range of hot rolling completion temperature Tf-50° C., within 1.0 second after the completion of the hot rolling is more preferable. This is because the growth of austenite crystal grain that has been refined by hot rolling can be suppressed. In order to perform cooling to a temperature range of hot rolling completion temperature Tf-50° C. or lower within 1.0 second after the completion of the hot rolling, cooling at a large average cooling rate is performed immediately after the completion of the hot rolling, for example, cooling water may be sprayed on the surface of the steel sheet. When cooling is performed to a temperature range of Tf-50° C. or lower within 1.0 second after the completion of the hot rolling, the grain size of the surface layer can be refined and resistance to cracking inside a bend of the hot-rolled steel sheet can be improved.

After cooling to the temperature range of the hot rolling completion temperature Tf-50° C. within 1.0 second after the completion of hot rolling, as described above, the accelerated cooling may be performed such that the average cooling rate to T2 (° C.) or lower is set to 30° C./s or higher.

(7-5) Average Cooling Rate from T2 (° C.) to Coiling Temperature is 30° C./s or Higher In order to suppress the area fraction of the ferrite, bainite, and pearlite to obtain the strength of TS ≥980 MPa, the average cooling rate from T2 (° C.) to the coiling temperature is preferably set to 30° C./s or higher. Accordingly, the primary phase structure can be full hard. The average cooling rate referred here refers to a value obtained by dividing the temperature drop width of the steel sheet from T2 (° C.) to the coiling temperature by the time required to reach the coiling from the time at which the steel sheet temperature reaches T2 (° C.).

When setting the average cooling rate to 30° C./s or higher, the area fraction of ferrite, bainite, and pearlite can be suppressed, and strength and hole expansibility can be secured. Therefore, the average cooling rate from T2 (° C.) to the coiling temperature is set to 30° C./s or higher.

(7-6) Coiling Temperature: 300° C. or Lower

The coiling temperature is preferably set to 300° C. or lower. When setting the coiling temperature to 300° C. or lower, it is possible to increase the transformation driving force from austenite to bcc and it is also possible to increase the deformation strength of austenite. Therefore, when transforming from austenite to bainite and martensite, the density $S_{60}$ of the length of grain boundary having a crystal misorientation of 60° about the <110> direction can be suppressed, and $S_{60}/S_7$ can be set to less than 0.60. As a result, the unevenness of the fracture surface in the end surface after shearing working can be reduced. In addition, it is also possible to suppress a decrease in hole expansibility due to the influence of residual austenite. Therefore, the coiling temperature is preferably set to 300° C. or lower. The coiling temperature is more preferably set to 50° C. or lower.

EXAMPLES

Next, the effects of one aspect of the present invention will be described more specifically by way of examples, but the conditions in the examples are condition examples adopted for confirming the feasibility and effects of the present invention. The present invention is not limited to these condition examples. The present invention can employ various conditions as long as the object of the present invention is achieved without departing from the gist of the present invention.

Steels having chemical compositions shown in Steel Nos. A to S in Tables 1 and 2 were melted and continuously cast to manufacture slabs having a thickness of 240 to 300 mm. The obtained slabs were used to obtain hot-rolled steel sheets shown in Tables 4A and 4B under the manufacturing conditions shown in Tables 3A and 3B.

The slab was allowed to retain in the temperature range of 700° C. to 850° C. for the retention time shown in Tables 3A and 3B, and then further heated to the heating temperature shown in Tables 3A and 3B and retained. In addition, the accelerated cooling was started within 1.5 seconds after the completion of hot rolling.

For the obtained hot-rolled steel sheet, the area fraction of each structure, $S_{60}/S_7$, the standard deviation of the Mn concentration, and the average grain size of the surface layer were determined by the above-described method. The obtained measurement results are shown in Tables 4A and 4B.

Evaluation Method of Properties of Hot-Rolled Steel Sheet (1) Tensile Strength Properties And Hole Expansion Ratio Among the mechanical properties of the obtained hot-rolled steel sheet, the tensile strength properties were evaluated according to JIS Z 2241:2011, and the hole expansion ratio was evaluated according to JIS Z 2256:2010. A test piece was a No. 5 test piece of JIS Z 2241:2011. The sampling position of the tensile test piece may be ¼ portion from the end portion in the sheet width direction, and the direction perpendicular to the rolling direction was the longitudinal direction.

In a case where the tensile strength TS ≥980 MPa was satisfied, the strength was determined excellent, which was pass. On the other hand, in a case where the tensile strength TS<980 MPa was satisfied, the strength was determined poor, which was fail.

Also, in a case where the tensile strength TS×the hole expansion ratio λ≥60000 (MPa·%) was satisfied, the hole expansibility was determined excellent, which was pass. On the other hand, in a case where the tensile strength TS×hole expansion ratio λ<60000 (MPa·%) was satisfied, the hole expansibility was determined poor, which was fail.

(2) Shearing Workability

The shearing workability of the hot-rolled steel sheet was evaluated by measuring the size of the unevenness of the fracture surface in the end surface after the shearing working by a punching test. Five punched holes were prepared with a hole diameter of 10 mm, a clearance of 10%, and a punching speed of 3 m/s. Next, a cross section of the five punched holes parallel to the rolling direction in ten places was embedded in a resin, and the cross-section shape was imaged with a scanning electron microscope. In the obtained observation photograph, it was possible to observe a processed cross section configured of shear droop, a shear surface, a fracture surface, and burrs as shown in FIG. 1.

The shear droop is a region of an R-shaped smooth surface. The shear surface is a region of a punched end surface separated by shearing deformation. The fracture surface is a region of a punched end surface separated by cracks initiated from the vicinity of the cutting edge after the completion of the shearing deformation. The burr is a surface having projections projecting from a lower surface of a hot-rolled steel sheet.

In the observation photograph, a straight line (straight line 1 in FIG. 1) parallel to the shear surface of the hot-rolled steel sheet and passing through a starting point A of the burrs was drawn. Further, in the recessed part of the fracture surface which is parallel to the straight line 1, a straight line 2-1 passing through a point B having the maximum distance from the straight line 1 was drawn. In the projection of the fracture surface which is parallel to the straight line 1, a straight line 2-1 passing through a point C having the maximum distance from the straight line 1 was drawn. A value of half of the distance between the straight line 2-1 and the straight line 2-2 (half the value of d in FIG. 1) was defined as the size of the unevenness of the fracture surface. The size of the unevenness of the fracture surface was measured for 10 end surfaces obtained from the 5 punched holes. When the maximum value of the size of the unevenness of the fracture surface is 3.0 μm or less, the shearing workability was determined excellent, which was pass. On the other hand, when the maximum value of the size of the unevenness of the fracture surface is more than 3.0 μm, the shearing workability was determined poor, and which was fail.

(3) Resistance to Cracking Inside Bend

As a bending test piece, a strip-shaped test piece having a size of 100 mm×30 mm was cut out from a ½ position in the sheet width direction of the hot-rolled steel sheet, and the resistance to cracking inside a bend was evaluated by the following bending test.

Regarding both bending (L-axis bending) in which a bending ridge is parallel to the rolling direction (L direction) and bending (C-axis bending) in which a bending ridge is parallel to the direction perpendicular to the rolling direction (C direction), the resistance to cracking inside a bend is studied in accordance with JIS Z 2248:2014 (V block 90° bending test), the minimum bending radius at which cracks are not initiated is determined, and a value obtained by dividing an average value R of the minimum bending radii of the L axis and the C axis by the sheet thickness t is defined as a limit bending R/t, which is an index value of bendability. When the R/t≤3.0, it was determined that the hot-rolled steel sheet was excellent in resistance to cracking inside a bend.

However, regarding the presence or absence of cracks, a crack was observed with an optical microscope, after mirror polishing the cross section obtained by cutting the test piece after the V block 90° bending test on a plane parallel to the bending direction and perpendicular to the sheet surface, and when the crack length observed inside the bend of the test piece is more than 30 μm, it is determined that there is a crack.

The obtained measurement results are shown in Tables 4A and 4B.

TABLE 1

| Steel | Mass % Remainder consisting of Fe and impurities | | | | | | | | | | | |
|---|---|---|---|---|---|---|---|---|---|---|---|---|
| No. | C | Si | Mn | sol. Al | P | S | N | O | Ti | Nb | V | Remarks |
| A | 0.051 | 1.05 | 1.94 | 0.037 | 0.013 | 0.0012 | 0.0037 | 0.0019 | 0.082 | | | Invention Example |
| B | 0.099 | 1.48 | 2.12 | 0.077 | 0.031 | 0.0045 | 0.0025 | 0.0012 | | | | Invention Example |
| C | 0.180 | 1.18 | 1.72 | 0.058 | 0.020 | 0.0029 | 0.0039 | 0.0034 | 0.060 | | | Invention Example |

TABLE 1-continued

| Steel | Mass % Remainder consisting of Fe and impurities | | | | | | | | | | | |
|---|---|---|---|---|---|---|---|---|---|---|---|---|
| No. | C | Si | Mn | sol. Al | P | S | N | O | Ti | Nb | V | Remarks |
| D | 0.097 | 0.21 | 1.78 | 0.052 | 0.032 | 0.0032 | 0.0021 | 0.0022 | 0.010 | | | Invention Example |
| E | 0.075 | 2.81 | 1.88 | 0.039 | 0.013 | 0.0015 | 0.0029 | 0.0012 | 0.099 | | | Invention Example |
| F | 0.092 | 1.06 | 1.29 | 0.052 | 0.015 | 0.0040 | 0.0008 | 0.0033 | 0.111 | | | Invention Example |
| G | 0.084 | 1.14 | 3.82 | 0.028 | 0.018 | 0.0028 | 0.0018 | 0.0042 | 0.078 | | | Invention Example |
| H | 0.094 | 0.84 | 1.72 | 0.031 | 0.023 | 0.0018 | 0.0059 | 0.0021 | 0.027 | 0.024 | | Invention Example |
| I | 0.120 | 1.28 | 1.77 | 0.044 | 0.032 | 0.0049 | 0.0051 | 0.0039 | | | | Invention Example |
| J | 0.096 | 1.03 | 1.87 | 0.035 | 0.023 | 0.0050 | 0.0028 | 0.0050 | 0.014 | 0.015 | 0.026 | Invention Example |
| K | 0.089 | 0.93 | 1.88 | 0.023 | 0.011 | 0.0035 | 0.0054 | 0.0047 | 0.108 | | | Invention Example |
| L | 0.080 | 0.89 | 1.58 | 0.052 | 0.026 | 0.0025 | 0.0034 | 0.0013 | 0.115 | | | Invention Example |
| M | 0.095 | 1.12 | 1.72 | 0.023 | 0.018 | 0.0032 | 0.0021 | 0.0039 | 0.110 | | | Invention Example |
| N | 0.077 | 1.08 | 1.67 | 0.041 | 0.017 | 0.0033 | 0.0025 | 0.0021 | 0.112 | | | Invention Example |
| O | 0.091 | 1.17 | 1.90 | 0.039 | 0.025 | 0.0027 | 0.0018 | 0.0048 | 0.134 | | | Invention Example |
| P | 0.034 | 0.92 | 1.85 | 0.022 | 0.015 | 0.0031 | 0.0028 | 0.0014 | 0.122 | | | Comparative Example |
| Q | 0.260 | 0.95 | 1.68 | 0.073 | 0.031 | 0.0031 | 0.0091 | 0.0024 | 0.105 | | | Comparative Example |
| R | 0.088 | 3.20 | 1.84 | 0.039 | 0.013 | 0.0030 | 0.0074 | 0.0048 | 0.134 | | | Comparative Example |
| S | 0.089 | 0.90 | 0.35 | 0.037 | 0.022 | 0.0014 | 0.0098 | 0.0024 | 0.112 | | | Comparative Example |

An underline indicates that the value is outside a range of the present invention.

TABLE 2

| Steel | Mass % Remainder consisting of Fe and impurities | | | | | | | | | | | | | | | | |
|---|---|---|---|---|---|---|---|---|---|---|---|---|---|---|---|---|---|
| No. | Cu | Cr | Mo | Ni | B | Ca | Mg | REM | Bi | Zr | Co | Zn | W | Sn | T1 | T2 | Remarks |
| A | | | | | | 0.0021 | 0.0015 | | | | | | | | 751 | 582 | Invention Example |
| B | | | | | | | | | | | | | | | 740 | 552 | Invention Example |
| C | | | | | | | | 0.0023 | | | | | | | 723 | 567 | Invention Example |
| D | | 0.28 | 0.31 | 0.51 | | | | | | | | | | | 701 | 519 | Invention Example |
| E | | | | | | | | | 0.007 | | | | 0.10 | | 789 | 581 | Invention Example |
| F | | | | | | | | | | | | | | | 783 | 629 | Invention Example |
| G | | | | | | | | | | | | | | | 610 | 404 | Invention Example |
| H | | | | | | | | | | 0.02 | | | | | 742 | 590 | Invention Example |
| I | | | | | | | | | | | | | | | 742 | 578 | Invention Example |
| J | | | | | | | | | | | | | | | 737 | 576 | Invention Example |
| K | 0.08 | | | | | | | | | | 0.12 | | | | 732 | 577 | Invention Example |
| L | | 0.22 | | | | | | | | | | | | | 758 | 591 | Invention Example |
| M | | | 0.17 | | | | | | | | | | | 0.02 | 747 | 575 | Invention Example |
| N | | | | 0.32 | | | | | | | | | | | 749 | 587 | Invention Example |
| O | | | | | 0.0013 | | | | | | | 0.05 | | | 741 | 574 | Invention Example |
| P | | | | | | | | | | | | | | | 757 | 594 | Comparative Example |
| Q | | | | | | | | | | | | | | | 692 | 549 | Comparative Example |
| R | | | | | | | | | | | | | | | 796 | 581 | Comparative Example |
| S | | | | | | | | | | | | | | | 840 | 714 | Comparative Example |

TABLE 3A

| Production No. | Steel No. | Retention time in temperature range of 700° C. to 850° C. s | Heating temperature ° C. | Retention time in temperature range of 1100° C. or higher s | Sheet thickness reduction in temperature range of 850° C. to 1100° C. % | T1 | Hot rolling completion temperature Tf ° C. | Cooling amount within 1.0 second after completion of hot rolling ° C. |
|---|---|---|---|---|---|---|---|---|
| 1 | A | 1346 | 1225 | 9016 | 93 | 751 | 954 | 100 |
| 2 | B | 1203 | 1230 | 9005 | 90 | 740 | 940 | 97 |
| 3 | B | 819 | 1218 | 7662 | 91 | 740 | 954 | 66 |
| 4 | B | 1194 | 1226 | 7673 | 87 | 740 | 969 | 114 |
| 5 | B | 1404 | 1217 | 5660 | 92 | 740 | 942 | 88 |
| 6 | B | 1271 | 1213 | 9098 | 93 | 740 | 948 | 5 |
| 7 | B | 1502 | 1222 | 7476 | 92 | 740 | 950 | 111 |
| 8 | B | 1285 | 1226 | 9002 | 91 | 740 | 965 | 104 |
| 9 | B | 1141 | 1229 | 7220 | 93 | 740 | 935 | 93 |
| 10 | B | 1278 | 1232 | 8292 | 91 | 740 | 964 | 100 |
| 11 | C | 1282 | 1223 | 7065 | 90 | 723 | 949 | 13 |
| 12 | D | 1545 | 1207 | 8018 | 91 | 701 | 960 | 77 |
| 13 | E | 1160 | 1230 | 8723 | 90 | 789 | 937 | 99 |
| 14 | F | 1315 | 1216 | 8814 | 90 | 783 | 937 | 111 |
| 15 | G | 1421 | 1221 | 8497 | 92 | 610 | 1019 | 120 |
| 16 | H | 1137 | 1191 | 7204 | 93 | 742 | 963 | 63 |
| 17 | I | 1349 | 1229 | 7788 | 91 | 742 | 964 | 82 |
| 18 | J | 1198 | 1229 | 8506 | 93 | 737 | 942 | 117 |
| 19 | K | 1212 | 1208 | 8922 | 93 | 732 | 952 | 118 |
| 20 | L | 1289 | 1194 | 6935 | 92 | 758 | 955 | 28 |
| 21 | M | 1292 | 1190 | 7295 | 93 | 747 | 940 | 100 |
| 22 | N | 1224 | 1214 | 8934 | 93 | 749 | 935 | 74 |
| 23 | O | 1297 | 1218 | 8243 | 92 | 741 | 936 | 108 |
| 24 | P | 1415 | 1215 | 7620 | 92 | 757 | 935 | 66 |
| 25 | Q | 1338 | 1192 | 7631 | 93 | 692 | 958 | 116 |
| 26 | R | 1515 | 1201 | 7686 | 90 | 796 | 960 | 93 |
| 27 | S | 1156 | 1217 | 7045 | 91 | 840 | 949 | 62 |

An underline indicates that a manufacturing condition is not preferable.

TABLE 3B

| Production No. | Steel No. | Average cooling rate in temperature range from cooling start to T2 (accelerated cooling) ° C./s | T2 | Cooling start temperature ° C. | Cooling time s | Average cooling rate in temperature range from T2 to coiling temperature ° C./s | Coiling temperature ° C. | Remarks |
|---|---|---|---|---|---|---|---|---|
| 1 | A | 76 | 582 | | 0 | 57 | 24 | Invention Example |
| 2 | B | 63 | 552 | | 0 | 73 | 21 | Invention Example |
| 3 | B | 66 | 552 | | 0 | 70 | 41 | Comparative Example |
| 4 | B | 63 | 552 | | 0 | 65 | 20 | Comparative Example |
| 5 | B | 76 | 552 | | 0 | 77 | 36 | Comparative Example |
| 6 | B | 78 | 552 | | 0 | 70 | 12 | Invention Example |
| 7 | B | 64 | 552 | | 0 | 25 | 41 | Comparative Example |
| 8 | B | 22 | 552 | | 0 | 76 | 28 | Comparative Example |
| 9 | B | 28 | 552 | 620 | 3.0 | 59 | 42 | Comparative Example |
| 10 | B | 63 | 552 | | 0 | 28 | 21 | Comparative Example |
| 11 | C | 59 | 567 | | 0 | 69 | 30 | Invention Example |
| 12 | D | 75 | 519 | | 0 | 60 | 10 | Invention Example |
| 13 | E | 64 | 581 | | 0 | 64 | 13 | Invention Example |
| 14 | F | 68 | 629 | | 0 | 55 | 19 | Invention Example |
| 15 | G | 68 | 404 | | 0 | 56 | 37 | Invention Example |
| 16 | H | 68 | 590 | | 0 | 62 | 34 | Invention Example |
| 17 | I | 74 | 578 | | 0 | 64 | 39 | Invention Example |
| 18 | J | 55 | 576 | | 0 | 70 | 12 | Invention Example |
| 19 | K | 77 | 577 | | 0 | 76 | 15 | Invention Example |
| 20 | L | 69 | 591 | | 0 | 55 | 25 | Invention Example |
| 21 | M | 63 | 575 | | 0 | 66 | 39 | Invention Example |
| 22 | N | 74 | 587 | | 0 | 72 | 23 | Invention Example |
| 23 | O | 77 | 574 | | 0 | 60 | 30 | Invention Example |
| 24 | P | 66 | 594 | | 0 | 64 | 29 | Comparative Example |
| 25 | Q | 64 | 549 | | 0 | 65 | 12 | Comparative Example |
| 26 | R | 77 | 581 | | 0 | 64 | 29 | Comparative Example |
| 27 | S | 76 | 714 | | 0 | 69 | 40 | Comparative Example |

An underline indicates that a manufacturing condition is not preferable

TABLE 4A

| Production No. | Sheet thickness mm | Ferrite Area % | Residual austenite Area % | Martensite and tempered martensite Area % | Remainder in microstructure Area % | $S_{60}/S_7$ — | Mn standard deviation Mass % | Average grain size of surface layer μm |
|---|---|---|---|---|---|---|---|---|
| 1 | 2.2 | 4.0 | 1.0 | 92.5 | 2.5 | 0.40 | 0.45 | 2.3 |
| 2 | 2.3 | 2.0 | 0.1 | 96.0 | 1.9 | 0.55 | 0.42 | 2.4 |
| 3 | 2.3 | 3.0 | 2.0 | 92.0 | 3.0 | 0.40 | 0.62 | 2.4 |
| 4 | 2.3 | 2.5 | 0.0 | 93.0 | 4.5 | 0.41 | 0.63 | 2.4 |
| 5 | 2.3 | 5.6 | 0.0 | 93.0 | 1.4 | 0.24 | 0.62 | 2.6 |
| 6 | 2.4 | 2.0 | 1.0 | 93.0 | 4.0 | 0.43 | 0.44 | 3.9 |
| 7 | 2.3 | 0.0 | 2.0 | 85.2 | 12.8 | 0.24 | 0.44 | 2.7 |
| 8 | 2.3 | 6.0 | 0.4 | 91.0 | 2.6 | 0.41 | 0.44 | 2.2 |
| 9 | 2.3 | 5.2 | 0.1 | 93.0 | 1.7 | 0.30 | 0.43 | 2.7 |
| 10 | 2.3 | 6.3 | 2.0 | 84.3 | 7.4 | 0.14 | 0.47 | 2.9 |
| 11 | 2.3 | 3.0 | 2.1 | 93.2 | 1.7 | 0.43 | 0.42 | 3.3 |
| 12 | 2.3 | 1.6 | 0.0 | 98.0 | 0.4 | 0.50 | 0.46 | 2.2 |
| 13 | 2.3 | 0.5 | 2.7 | 96.0 | 0.8 | 0.43 | 0.49 | 2.3 |
| 14 | 2.3 | 2.0 | 0.2 | 95.0 | 2.8 | 0.43 | 0.34 | 2.4 |
| 15 | 1.7 | 1.0 | 0.1 | 98.0 | 0.9 | 0.50 | 0.58 | 2.2 |
| 16 | 2.4 | 2.2 | 1.4 | 92.5 | 3.9 | 0.50 | 0.38 | 2.2 |
| 17 | 2.3 | 1.5 | 0.0 | 94.5 | 4.0 | 0.36 | 0.40 | 2.2 |
| 18 | 2.3 | 0.0 | 0.6 | 97.0 | 2.4 | 0.55 | 0.49 | 2.6 |
| 19 | 4.8 | 2.1 | 0.7 | 95.5 | 1.7 | 0.45 | 0.41 | 2.9 |
| 20 | 2.2 | 1.7 | 0.0 | 93.0 | 5.3 | 0.39 | 0.39 | 3.5 |
| 21 | 2.5 | 2.5 | 1.2 | 95.5 | 0.8 | 0.43 | 0.47 | 2.5 |
| 22 | 2.5 | 1.1 | 2.5 | 92.5 | 3.9 | 0.35 | 0.43 | 2.8 |
| 23 | 2.5 | 1.5 | 0.6 | 92.8 | 5.1 | 0.38 | 0.49 | 2.8 |
| 24 | 2.6 | 4.0 | 0.4 | 93.0 | 2.6 | 0.24 | 0.48 | 2.2 |
| 25 | 2.6 | 4.5 | 3.0 | 88.0 | 4.5 | 0.28 | 0.46 | 2.7 |
| 26 | 2.6 | 0.1 | 2.0 | 97.0 | 0.9 | 0.52 | 0.48 | 2.9 |
| 27 | 2.6 | 0.8 | 0.0 | 93.0 | 6.2 | 0.53 | 0.39 | 2.9 |

An underline indicates that the value is outside a range of the present invention or represents a property which is not preferable.

TABLE 4B

| Production No. | Tensile strength TS MPa | Hole expansion ratio λ % | TS × λ MPa-% | Maximum value of size of unevenness of fracture surface μm | Limit bending R/t — | Remarks |
|---|---|---|---|---|---|---|
| 1 | 981 | 72 | 70632 | 1.0 | 2.5 | Invention Example |
| 2 | 1065 | 65 | 69225 | 0.5 | 2.7 | Invention Example |
| 3 | 1066 | 62 | 66092 | 4.0 | 2.5 | Comparative Example |
| 4 | 1044 | 63 | 65772 | 3.5 | 2.6 | Comparative Example |
| 5 | 940 | 67 | 62980 | 4.2 | 2.5 | Comparative Example |
| 6 | 1057 | 62 | 65534 | 3.0 | 3.4 | Invention Example |
| 7 | 948 | 52 | 49296 | 3.1 | 2.8 | Comparative Example |
| 8 | 962 | 60 | 57720 | 3.5 | 2.7 | Comparative Example |
| 9 | 890 | 72 | 64080 | 4.5 | 2.6 | Comparative Example |
| 10 | 957 | 65 | 62205 | 5.0 | 2.8 | Comparative Example |
| 11 | 1332 | 65 | 86580 | 2.8 | 4.0 | Invention Example |
| 12 | 993 | 61 | 60573 | 2.5 | 2.7 | Invention Example |
| 13 | 1053 | 58 | 61074 | 2.0 | 2.5 | Invention Example |
| 14 | 1080 | 57 | 61560 | 2.5 | 2.6 | Invention Example |
| 15 | 1092 | 56 | 61152 | 2.8 | 2.9 | Invention Example |
| 16 | 984 | 61 | 60024 | 1.6 | 2.8 | Invention Example |
| 17 | 1078 | 56 | 60368 | 1.5 | 2.6 | Invention Example |
| 18 | 1032 | 60 | 61920 | 2.1 | 2.7 | Invention Example |
| 19 | 1063 | 62 | 65906 | 1.8 | 2.8 | Invention Example |
| 20 | 1049 | 64 | 67136 | 1.2 | 3.2 | Invention Example |
| 21 | 1046 | 58 | 60668 | 2.4 | 2.5 | Invention Example |
| 22 | 1054 | 62 | 65348 | 1.1 | 2.7 | Invention Example |
| 23 | 1032 | 60 | 61404 | 1.9 | 2.6 | Invention Example |
| 24 | 886 | 68 | 60248 | 2.2 | 2.8 | Comparative Example |
| 25 | 960 | 42 | 40320 | 3.0 | 2.9 | Comparative Example |
| 26 | 990 | 52 | 51480 | 2.5 | 3.8 | Comparative Example |
| 27 | 922 | 50 | 46100 | 2.1 | 2.6 | Comparative Example |

An underline indicates that the value is outside a range of the present invention or represents a property which is not preferable.

As can be seen from Tables 4A and 4B, the production Nos. 1, 2, 6, and 11 to 23 according to Invention Example, hot-rolled steel sheets having excellent strength, hole expansibility, and shearing workability were obtained. Furthermore, in Production Nos. 1, 2, 12 to 19, and 21 to 23 in which the average grain size of the surface layer is less than 3.0 μm, a hot-rolled steel sheet having excellent resistance to cracking inside a bend, in addition to having the above-mentioned various properties was obtained.

On the other hand, the production Nos. 3 to 5, 7 to 10, and 24 to 27 in which a chemical composition and a metallographic structure are not within the range specified in the present invention were poor in any one or more of the properties (tensile strength TS, hole expansion ratio λ, and shearing workability).

INDUSTRIAL APPLICABILITY

According to the above aspect of the present invention, it is possible to provide a hot-rolled steel sheet having excellent strength, hole expansibility, and shearing workability. Further, according to a preferred embodiment according to the present invention, it is possible to obtain a hot-rolled steel sheet having the above-mentioned various properties and further suppressing the occurrence of cracking inside a bend, that is, having excellent resistance to cracking inside a bend.

The hot-rolled steel sheet according to the present invention is suitable as an industrial material used for vehicle members, mechanical structural members, and building members.

The invention claimed is:

1. A hot-rolled steel sheet comprising, as a chemical composition, by mass %:

C: 0.040% to 0.250%;
Si: 0.05% to 3.00%;
Mn: 0.50% to 4.00%;
sol. Al: 0.001% to 2.000%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.00%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, or W: 0% to 1.00% in total;
Sn: 0% to 0.050%; and a remainder comprising of Fe and impurities, wherein a metallographic structure contains, by area %, more than 92.0% and 100.0% or less of martensite and tempered martensite in total, less than 3.0% of residual austenite, and less than 5.0% of ferrite, has a ratio $S_{60}/S_7$, which is a ratio of a density $S_{60}$ of a length of a grain boundary having a crystal misorientation of 60° to a density $S_7$ of a length of a grain boundary having a crystal misorientation of 7° about a <110> direction, of more than 0.34 and less than 0.60, has a standard deviation of a Mn concentration of 0.60 mass % or less, and has a tensile strength of 980 MPa or more.

2. The hot-rolled steel sheet according to claim 1, wherein an average grain size of a surface layer is less than 3.0 μm.

3. The hot-rolled steel sheet according to claim 1, wherein the hot-rolled steel sheet includes, as the chemical composition, by mass %, one or two or more selected from Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

4. The hot-rolled steel sheet according to claim 2, wherein the hot-rolled steel sheet includes, as the chemical composition, by mass %, one or two or more selected from Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.01% to 1.00%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

* * * * *